US006334736B1

(12) United States Patent
Johnson et al.

(10) Patent No.: US 6,334,736 B1
(45) **Date of Patent: *Jan. 1, 2002**

(54) FLOOD BARRIER

(75) Inventors: Harold Wayne Johnson; Donn Wittenberg; Charles T. Shankles, all of Knoxville, TN (US)

(73) Assignee: Aqua Levee, LLC, Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/408,806

(22) Filed: Sep. 30, 1999

Related U.S. Application Data

(63) Continuation-in-part of application No. 08/902,860, filed on Jul. 30, 1997, now Pat. No. 5,971,661.

(51) Int. Cl.[7] ..... E02B 7/20
(52) U.S. Cl. ..... 405/114; 405/107
(58) Field of Search ..... 405/15, 16, 17, 405/18, 19, 21, 22, 87, 90, 91, 107, 110, 111, 114, 115, 116

(56) References Cited

U.S. PATENT DOCUMENTS

| | | | | | |
|---|---|---|---|---|---|
| 3,213,628 | A | * | 10/1965 | Serota | 405/111 |
| 3,680,319 | A | | 8/1972 | Draper et al. | |
| 4,330,224 | A | | 5/1982 | Muramatsu et al. | |
| 4,692,060 | A | * | 9/1987 | Jackson, III | 405/115 |
| 4,784,520 | A | | 11/1988 | Stevens | |
| 4,921,373 | A | * | 5/1990 | Coffey | 405/115 |
| 4,966,491 | A | * | 10/1990 | Sample | 405/19 |
| 4,973,947 | A | | 11/1990 | Tax | |
| 5,040,919 | A | * | 8/1991 | Hendrix | 405/115 |
| 5,125,767 | A | | 6/1992 | Dooleage | |
| 5,176,468 | A | * | 1/1993 | Poole | 405/111 |
| 5,236,281 | A | | 8/1993 | Middleton | |
| 5,283,569 | A | | 2/1994 | Nelson | |
| 5,439,316 | A | | 8/1995 | Richardson | |
| 5,470,177 | A | | 11/1995 | Hughes | |
| 5,511,902 | A | | 4/1996 | Center | |
| 5,552,774 | A | | 9/1996 | Gridley | |
| 5,632,573 | A | | 5/1997 | Baker | |
| 5,857,806 | A | * | 1/1999 | Melin | 405/115 |
| 5,865,564 | A | * | 2/1999 | Miller et al. | 405/115 |
| 5,971,661 | A | * | 10/1999 | Johnson et al. | 405/114 |

* cited by examiner

*Primary Examiner*—David Bagnell
*Assistant Examiner*—Frederick L. Lagman
(74) *Attorney, Agent, or Firm*—Luedeka, Neely & Graham

(57) ABSTRACT

A barrier having a fluid-fillable body made of a non-rigid sheet material, a plurality of planar support members within the body for maintaining a desired shape of the barrier and a port for introducing fluid into the barrier.

8 Claims, 9 Drawing Sheets

FLOOD BARRIER

CROSS REFERENCE TO RELATED APPLICATION

This is a continuation-in-part of U.S. Application Ser. No. 08/902,860, filed Jul. 30, 1997, and entitled "Water Containment Device and Levee for Impeding a Flow of Water" (U.S. Pat. No. 5,971,661).

FIELD OF THE INVENTION

In general, the present invention relates to barriers and, in particular, the present invention relates to apparatus for impeding fluids, primarily water as may be experienced in a flood.

BACKGROUND AND SUMMARY OF THE INVENTION

Problems have existed for many years relating to an effective use of barriers for impeding flood waters. Typically, sandbags have been placed end to end to form a horizontal barrier and stacked one upon another to form a levee to impede the flow of water. The use of sandbags for this purpose has many disadvantages, because use of the sandbags requires transportation of a large quantity of sand for filling the bags, a great number of people to fill the sandbags, a long period of time to fill the sandbags, and environmental disposal of the sandbags, after the flow of water has subsided, as a result of oil, fuel, and other toxic chemicals that may have seeped into the sandbags.

The present invention eliminates the above difficulties and disadvantages of the prior art by providing a barrier and to a levee system made of a plurality of the barriers, with each barrier including a fluid-fillable body made of a non-rigid sheet material, a plurality of planar support members within the body for maintaining a desired shape of the barrier, and a port for introducing fluid into the barrier.

In another aspect, the invention relates to a barrier and a levee system made of a plurality of the barriers, wherein each barrier includes a body portion made of a non-rigid sheet material and having a first end, a second end in opposed relation to the first end.

The body portion includes first side attached to the first and second ends. A first planar support member made of a substantially rigid sheet material and having a width substantially equal to the width of the first side is attached to an interior surface of the first side for substantially maintaining the form of the first side.

A second side of the body portion is attached to the first and second ends and the first side, and a second planar structural support member made of a substantially rigid sheet material and having a width substantially equal to the width of the second side, is attached to an interior surface of the second side for maintaining the form of the second side; and a base is attached to the first and second ends and the first and second sides. The first and second ends and the first, second, and the base define the body portion, and a port is provided in fluid communication with an interior chamber of the body portion for introducing liquid into the interior chamber of the body portion.

A further aspect of the invention relates to a barrier and a levee system made of a plurality of the barriers, wherein each barrier includes a fluid-fillable body made of a plurality of portions of a non-rigid sheet material secured to a pair of planar support members, and a port for introducing fluid into the body.

A still further aspect of the invention relates to a barrier and a levee system made of a plurality of the barriers, wherein each barrier includes first and second planar support members made of a substantially rigid material and a plurality of a non-rigid sheet material portions attached to portions of the planar support members to define a continuous, fluid impervious enclosure. The non-rigid sheet material portions include first and second end portions, a bottom portion and an upper portion. At least one port is provided in fluid communication with the enclosure for introducing fluid into the enclosure.

Other objects, features and advantages of the present invention will become apparent by reference to the following detailed description when considered in conjunction with the accompanying drawings.

DETAILED DESCRIPTION

FIGS. 1A–6

Figure 1A:
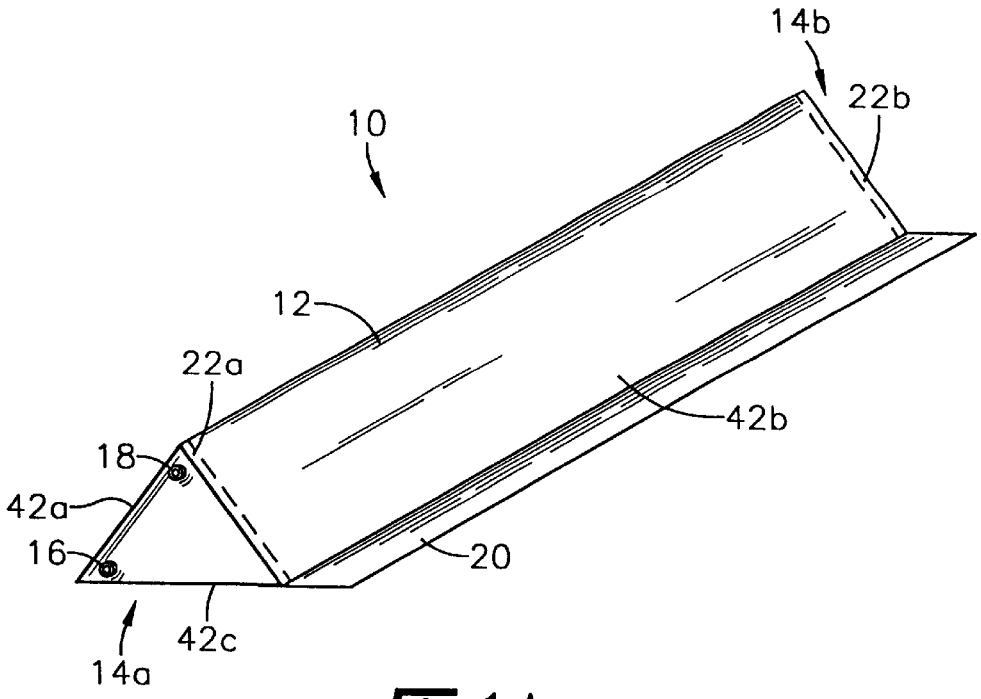
FIG. 1A is a perspective view of an apparatus for impeding a flow of water of the present invention.

Commencing with FIG. 1A, a barrier apparatus 10 is shown for impeding a flow of water. The apparatus 10 includes a body portion 12 that is elongated, and is preferably triangular in shape and forms an isosceles triangle. The body portion 12 is substantially hollow and includes an interior space for receiving a liquid substance therein that adds weight and stability to the apparatus 10. The apparatus 10 includes a first end 14*a* and a second end 14*b*, which are attached to the body portion 12, and axially opposed. The apparatus 10 further includes a base 42*c* to which is attached a first side 42*a* and a second side 42*b*. Preferably, the first side 42*a* and second side 42*b* each project at a 60° angle from the base 42*c* thereby forming the isosceles triangle.

Figure 4:
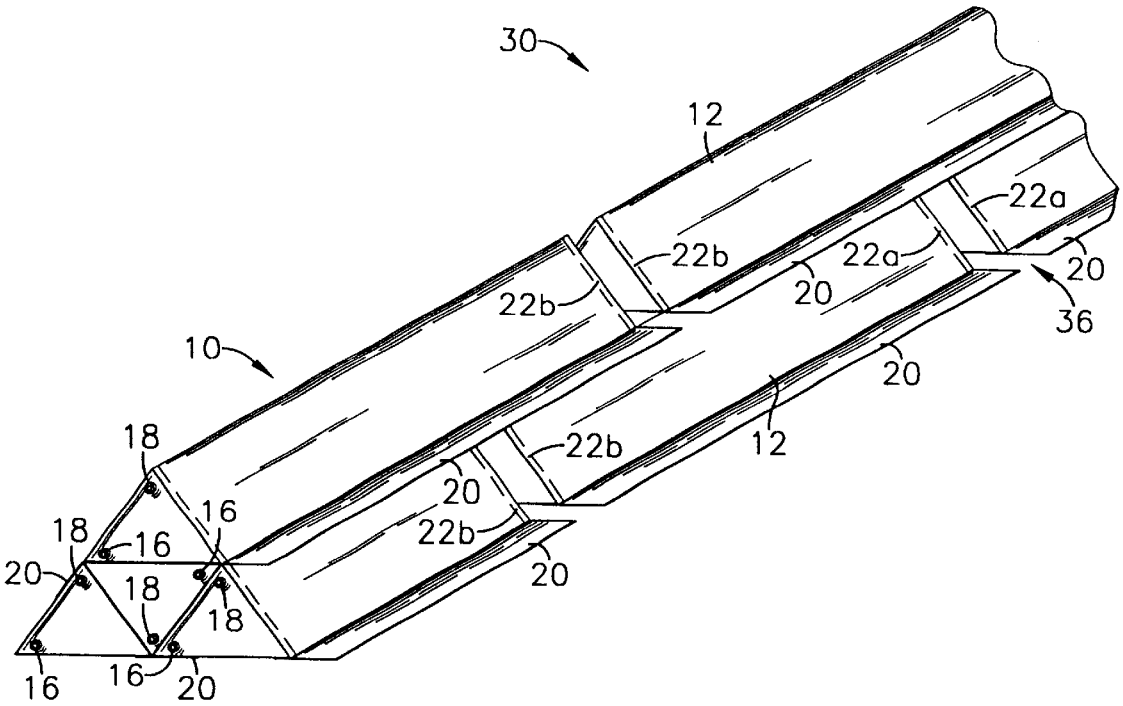
FIG. 4 is a perspective view of the levee of the present invention showing a dual fill and purge position points along the levee.
Figure 5:
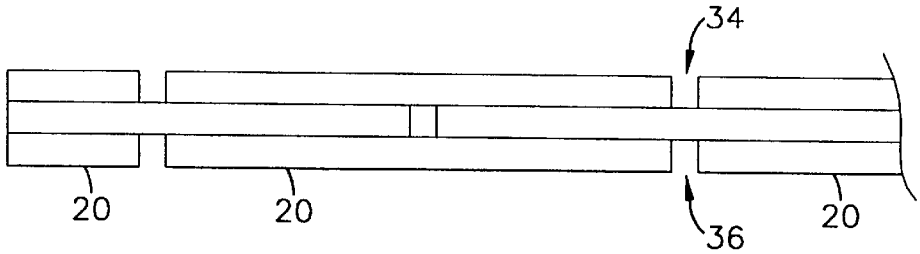
FIG. 5 is a plan view of the levee of the present invention showing a corner construction.

At least one valve is disposed in the first end 14*a* for introducing a liquid substance into the body portion 12. In preference, however, two valves are disposed in the first end 14*a* that comprise a fill valve 18 and a bleed valve 16. The fill and bleed valves 18 and 16, can be flush with the first end 14*a* but preferably protrude outward from the first end 14*a* for easy access. The bleed valve 16 is for releasing air contained within the substantially hollow body portion 12 while the liquid substance is being introduced therein via the fill valve 18. The apparatus 10 further includes a first flange 22*a* that is disposed around and attached to the first end 14*a*. The first flange 22*a* protrudes outward from the first end 14*a* a distance greater than the fill and bleed valves 18 and 16. Similarly, a second flange 22*b* is disposed around and attached to the second end 14*b* of the body portion 12. Preferably, the first and second flanges 22*a* and 22*b* are integrally formed with the body portion 12. As shown in FIGS. 4 and 5, by placing two apparatuses in axial alignment such that the first flanges 22*a* of each of the apparatuses 10 abut, dual fill and purge position points 34 and 36 are created such that an operator may simultaneously fill and purge two of the apparatuses 10 at a singular position. This will be discussed in greater detail below.

Figure 1B:
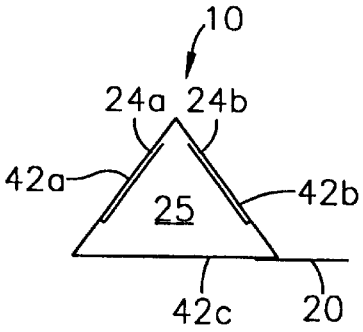
FIG. 1B is a cross-sectional view of the apparatus of the present invention.

Referring now to FIG. 1B, the apparatus 10 further includes a first support 24*a* attached to the first side 42*a* on the interior space of the body portion 12 for maintaining form of the first side 42*a* and for impeding the first side 42*a* of the body portion 12 from collapsing under weight of another apparatus stacked thereon. The apparatus 10 also includes a second support 24*b* that is attached to the second side 42*b* on the interior space of the body portion 12 for maintaining form of the second side 42*b* and for impeding the second side 42*b* from collapsing under weight stacked thereon. The first and second supports 24*a* and 24*b* also serve as baffles to quell movement of the liquid substance within the interior space of the body portion 12.

Figure 1C:
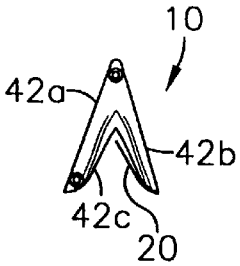
FIG. 1C is an end view of the apparatus of the present invention in a folded position.

As shown in FIG. 1C, the body portion 12 is collapsible for storage. To collapse the body portion 12, the base 42*c* is deformed into the interior space of the body portion 12 between the first and second sides 42*a* and 42*b*. The apparatus 10 may then be easily stacked for transportation and storage.

Preferably, the body portion 12, the fill and bleed valves 18 and 16, the first and second ends 14*a* and 14*b*, the flap 20, and the first and second flanges 22*a* and 22*b*, are formed from a non-porous, liquid repelling material such that any toxins or environmentally unsafe contaminants contained within the flow of water do not penetrate the apparatus 10. Therefore, the apparatus 10 may be reused and will not need to be disposed of in an environmentally safe fashion. Also preferably, the non-porous, liquid repelling material is comprised of Poly-Vinyl Chloride ("PVC").

Figure 2:
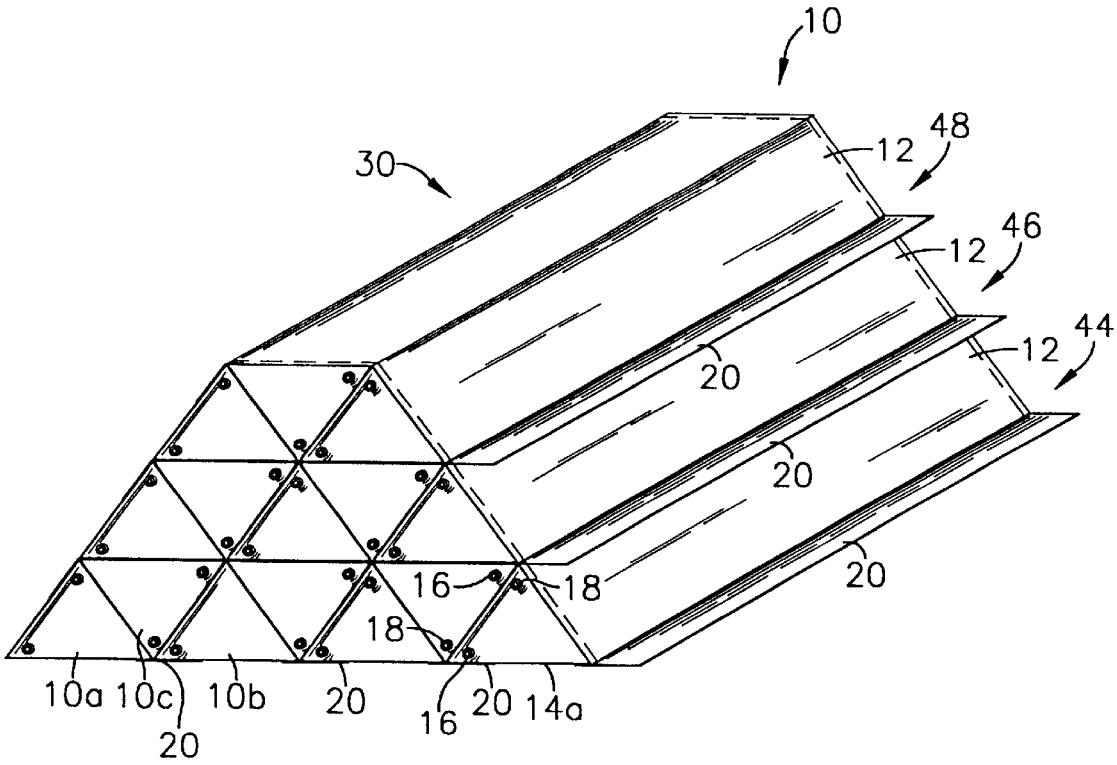
FIG. 2 is a perspective view of a levee of the present invention.
Figure 3:
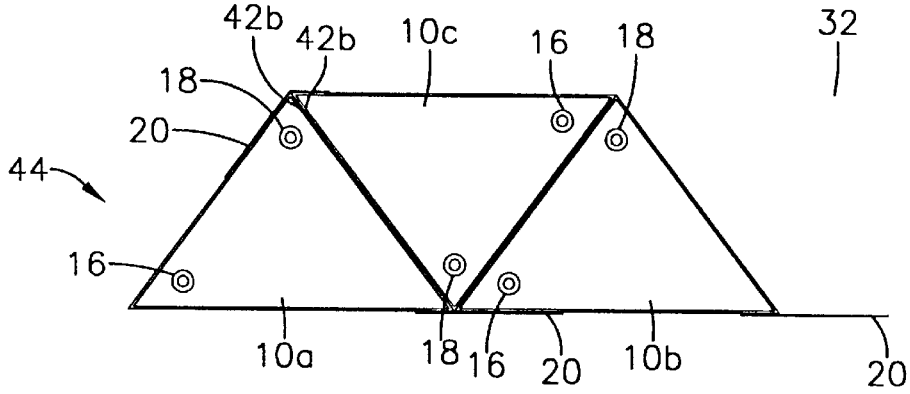
FIG. 3 is a front elevational view of the levee of the present invention.

Referring now to FIG. 2, a levee 30 for impeding the flow of water is shown and which comprises a plurality of apparatuses 10, each having the designs and functions stated above. The levee 30 includes a first level 44, a second level 46, and a third level 48 that each has at least one or a first apparatus 10 that includes a body portion 12 with a first end 14*a*, a second end 14*b*, a base 42*c* , and a first side 42*a* and a second side 42*b* attached to the base 42*c* as described above. The first apparatus 10 also includes a flap 20 attached to the body portion 12 and extending outward therefrom. The flap 20 can receive another apparatus thereon and thereby prevent movement of the first apparatus 10. The first level 44, as shown in FIGS. 2 and 3, includes a body portion 12 of the second apparatus 10*b* has a first end 14*a*, a second end 14*b*, a base 42*c*, a first side 42*a* and a second side 42*b* attached to the base 42*c*, and a flap 20 attached to the body portion 12 and extending outwardly therefrom. The flap 20 is for receiving another apparatus 10 thereon and impeding movement of the second apparatus 10*b*. The first level 44 further includes a third apparatus 10*c* disposed between the first and second apparatuses 10*a* and 10*b* such that a first side of the third apparatus 10*c* is abutting the first side 42*a* of the second apparatus 10*b*. Moreover, a second side of the third apparatus 10*c* is abutting the second side 42*b* of the first apparatus 10*a* such that the base 42*c* of the second apparatus 10*b* is at least partially disposed on the flap 20 of the first apparatus 10*a*. When this occurs, and the second apparatus 10*b* is filled with the liquid substance via fill valve 18, the first apparatus 10*a* will be secured in place via weight of the second apparatus 10*b* being applied to the flap 20. Also, in construction of the first level 44 of the present invention, the flap 20 of the third apparatus 10*c* is overlain at least part of the first side 42*a* of the first apparatus 10*a*.

As shown in FIG. 3, if the flow of water 32 rises above the first level 44, or to a level greater than the entire levee 30, the flow of water 32 will be diverted away from flowing between the first side 42*a* of the third apparatus 10*c* and the second side 42*b* of the first apparatus 10*a* thereby keeping the levee 30 in tact. The levee 30 further includes a second level 46 that includes a fourth apparatus 10 having a body portion 12 with a first end 14*a*, a second end 14*b*, a base 42*c* and a first side 42*a* and a second side 42*b* attached to the base 42*c*. The base of the fourth apparatus is disposed on the base 42*c* of the third apparatus 10*c*. It is understood, however, that only a singularly row of apparatuses need be used to form the levee 30 of the present invention.

As shown in FIGS. 4 and 5, dual fill and purge position points 34 and 36 are provided along the levee 30 so that an operator can simultaneously fill and bleed two of the apparatuses 10 from a singular position and from any level of the levee 30. To accomplish this task, the apparatuses 10 must be axially aligned such that the first ends of two apparatuses are placed adjacent to each other so that the fill and bleed valves 18 and 16 can be accessed simultaneously for the two apparatuses. All of the apparatuses 10 used in the levee 30 are preferably constructed of a non-porous liquid repelling material. Preferably, the liquid repelling material is comprised of PVC, and the entire levee is therefore constructed of liquid repelling material because the individual apparatuses are all comprised of the liquid repelling material. Also, any two apparatuses 10 contained in any level of the levee 30 can be filled simultaneously if the apparatuses are placed such that the first end of each apparatus are adjacent.

Figure 6:
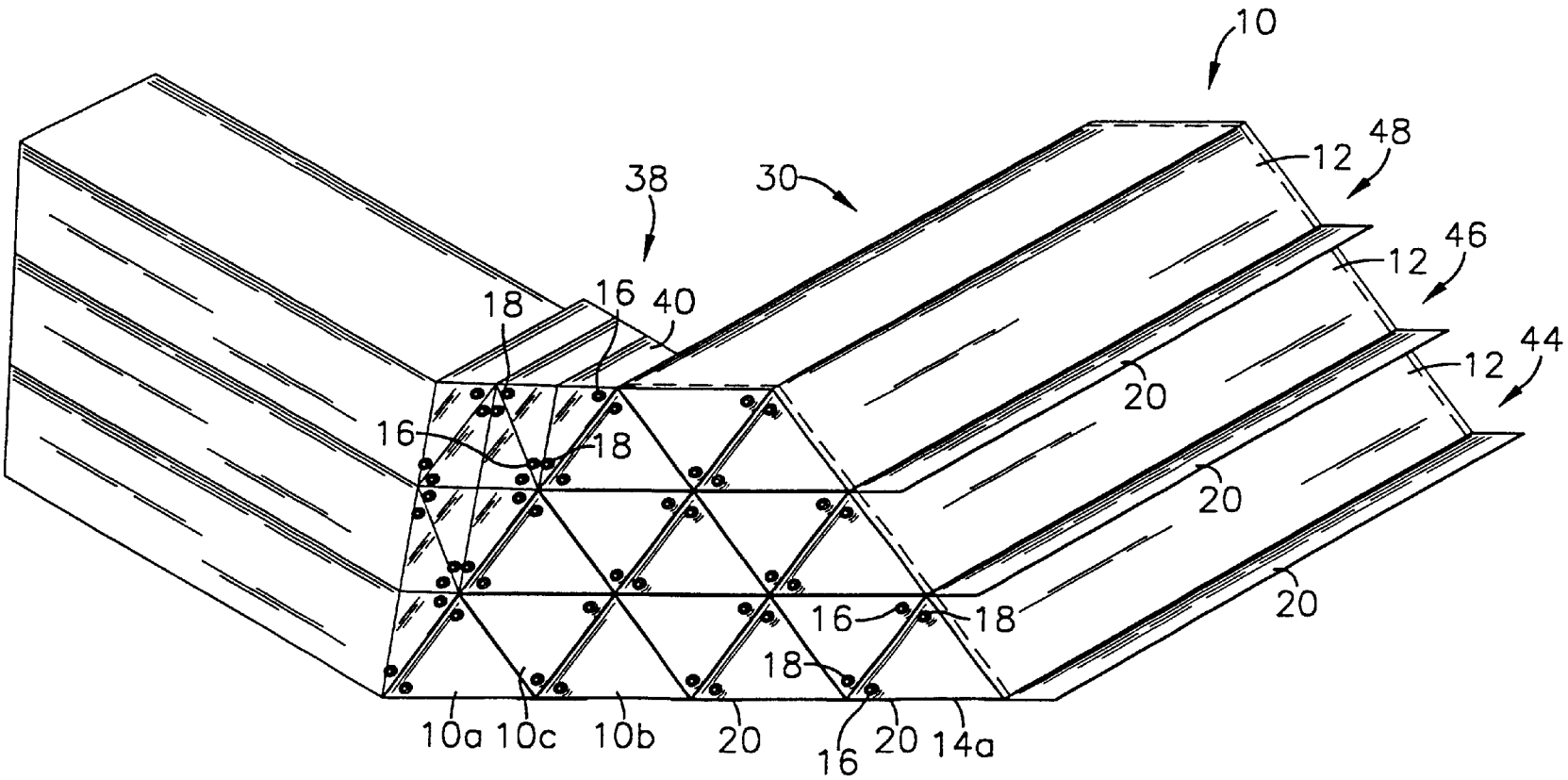
FIG. 6 is a perspective view of the levee of the present invention formed in a ninety degree angle.

Referring now to FIG. 6, a further embodiment of the present invention is shown whereby a 90° corner is formed in the levee 30. To form the corner, two levees of equal height each having a plurality of apparatuses 10, preferably having first and second sides 42*a* and 42*b* extending at 60° angles from the base 42*c*, are placed perpendicular. A gap will be created between the two perpendicular levees such that the gap is equal in height to the upper most level of the two levees and has two sides extending at 30° angles. To fill the gap, a plurality of wedge shaped devices 38 are provided, each having an elongated triangular shaped body portion 40 with one angle being at a 90° or right angle. Similar to the apparatuses 10 making up the perpendicular levees, the wedge shaped apparatuses 38, which fill the gap therebetween have fill and bleed valves 18 and 16 for filling the wedge shaped devices 38 with a liquid substance while bleeding air from the body portion 40.

FIGS. 7–11

Figure 7:
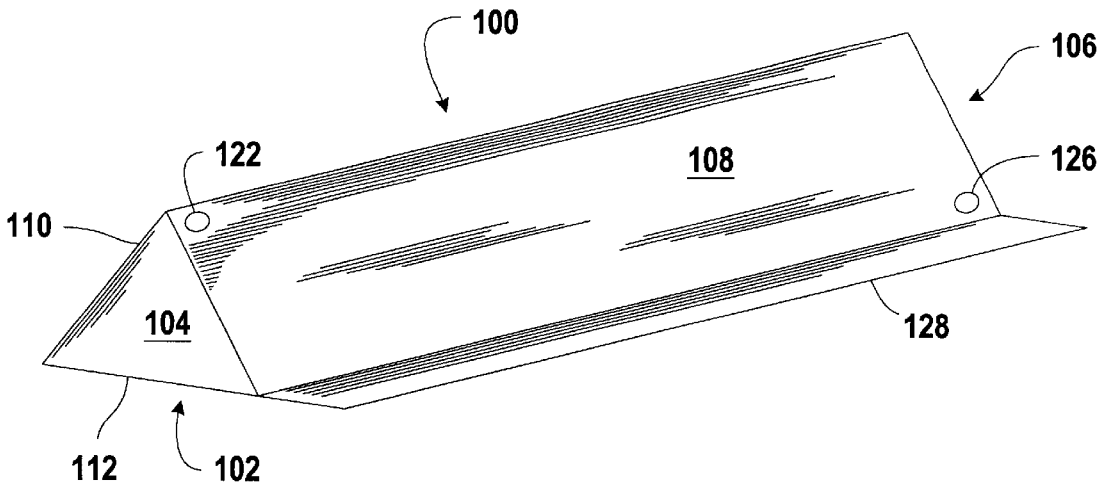
FIG. 7 is a perspective view of an alternate embodiment of a barrier in accordance with the invention.
Figure 8:
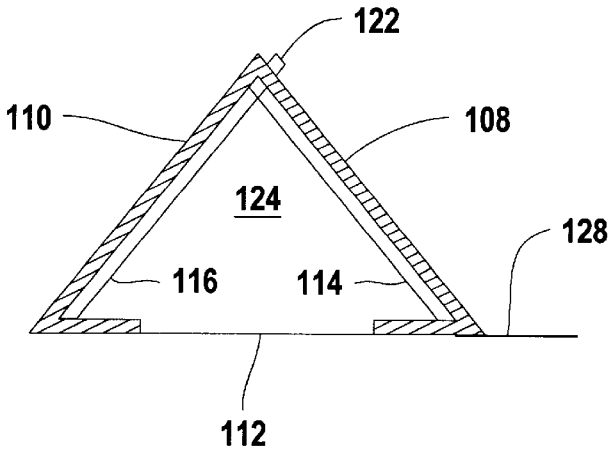
FIG. 8 is a cross-sectional end view of the barrier of FIG. 7.

With reference to FIG. 7, there is shown a perspective view of an alternate embodiment of a barrier 100 in accordance with the invention. The barrier 100 includes a body portion 102 made of a non-rigid sheet material and having a first end 104, a second end 106 in opposed relation to the first end, a first side 108 attached to the first and second ends, a second side 110 attached to the first and second ends and the first side, and a bottom 112 attached to the first and second sides 108, 110 and the first and second ends 104, 106. The barrier 100 is preferably triangular in cross-section but may have other geometric configurations, such as trapezoidal, with all sides except the ends and bottom preferably having a planar support member therewith.

With additional reference to FIGS. 8–11, a first planar support member 114 made of a substantially rigid sheet material and having a width substantially equal to the width of the first side 108 is attached to an interior surface 116 of the first side 108 for maintaining the form of the first side 108. A second planar structural support member 118 made of a substantially rigid sheet material and having a width substantially equal to the width of the second side 110 is attached to an interior surface 120 of the second side 110 for maintaining the form of the second side 110. The support members 114 and 118 preferably each have a length L and a width W substantially corresponding to the length and width of the sides 108 and 110, with one support member being utilized for each side. Alternatively, the support members 114, 118 may have a length that is substantially less than the length of the side with which they are used, with a plurality of support members being utilized in a number sufficient to substantially span the width of the side of the body portion 102.

The support members 114 and 118 are preferably made of a substantially rigid plastic sheet materials such as polyvinyl chloride having a thickness of from about 0.05 to about 0.25 inches. The support members 114 and 118 may be attached to the surfaces 116 and 120 as by adhesive or heat sealing.

A port 122 is provided in fluid communication with an interior chamber 124 of the body portion 102 for introducing fluid, such as water, into the interior chamber 124 of the body portion 102. The port 122 preferably includes a removable cap for selectively sealing the port 122. The port 122 can be used for both introducing and removing fluid from the chamber 124, however, it is preferred that the port 122 have an internal one-way valve to only allow fluid to enter the chamber 124 and that a separate port 126 be provided, preferably at an opposite end of the chamber 124, for draining fluid from the chamber. In this regard, the port 122 is preferably adjacent the juncture of the first and second sides 108, 110, and the port 126 adjacent the juncture of the side 108 and the bottom 112.

A flap 128, similar to the flap 20 previously described in connection with FIGS. 1–6, preferably extends from the bottom 112. The flap 128 is preferably attached as by heat sealing a length portion of the flap 128 to the bottom 112. In this regard, it will be appreciated that the components of the body portion 102 are preferably made of a substantially water impervious and flexible material such as plastic sheeting, preferably reinforced polyvinyl chloride (PVC). The juncture of each component of the body portion 102 is preferably substantially water-tight and provided by overlapping the joined components and heat sealing them along the region of overlap so that the heat seal is substantially continuous and the fused material provides a fluid impervious seal between the joined components.

Figure 9:
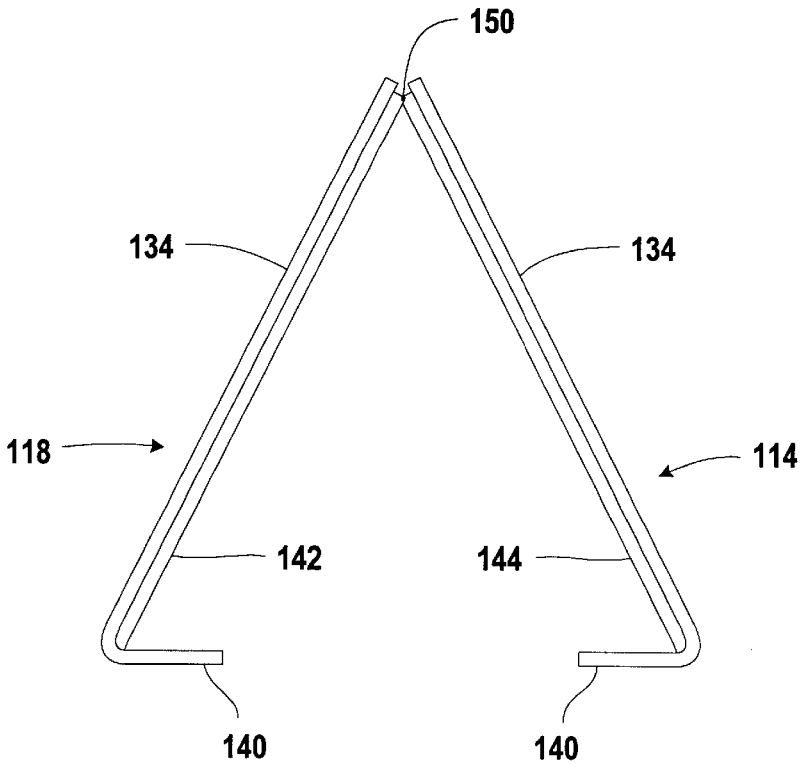
FIG. 9 is an end view showing a pair of supports for use in the barrier of FIG. 7.
Figure 10:
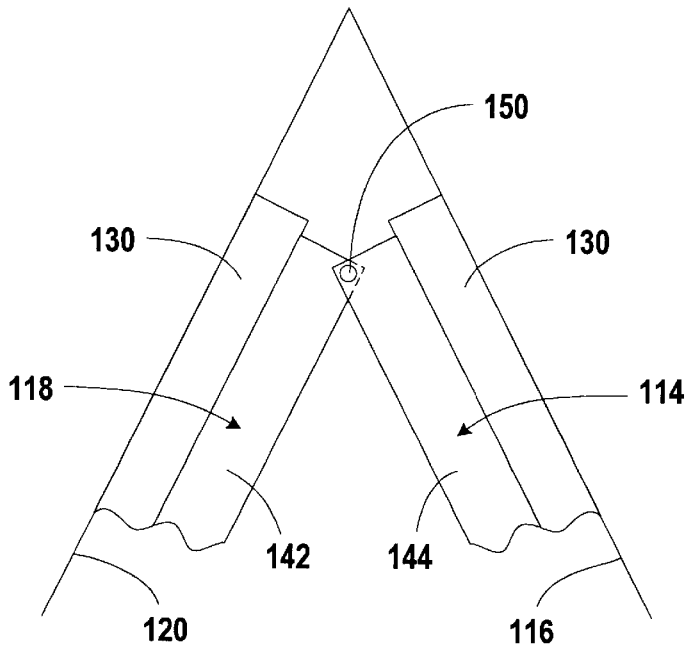
FIG. 10 is a close-up view of a portion of the supports of FIG. 9.
Figure 11:
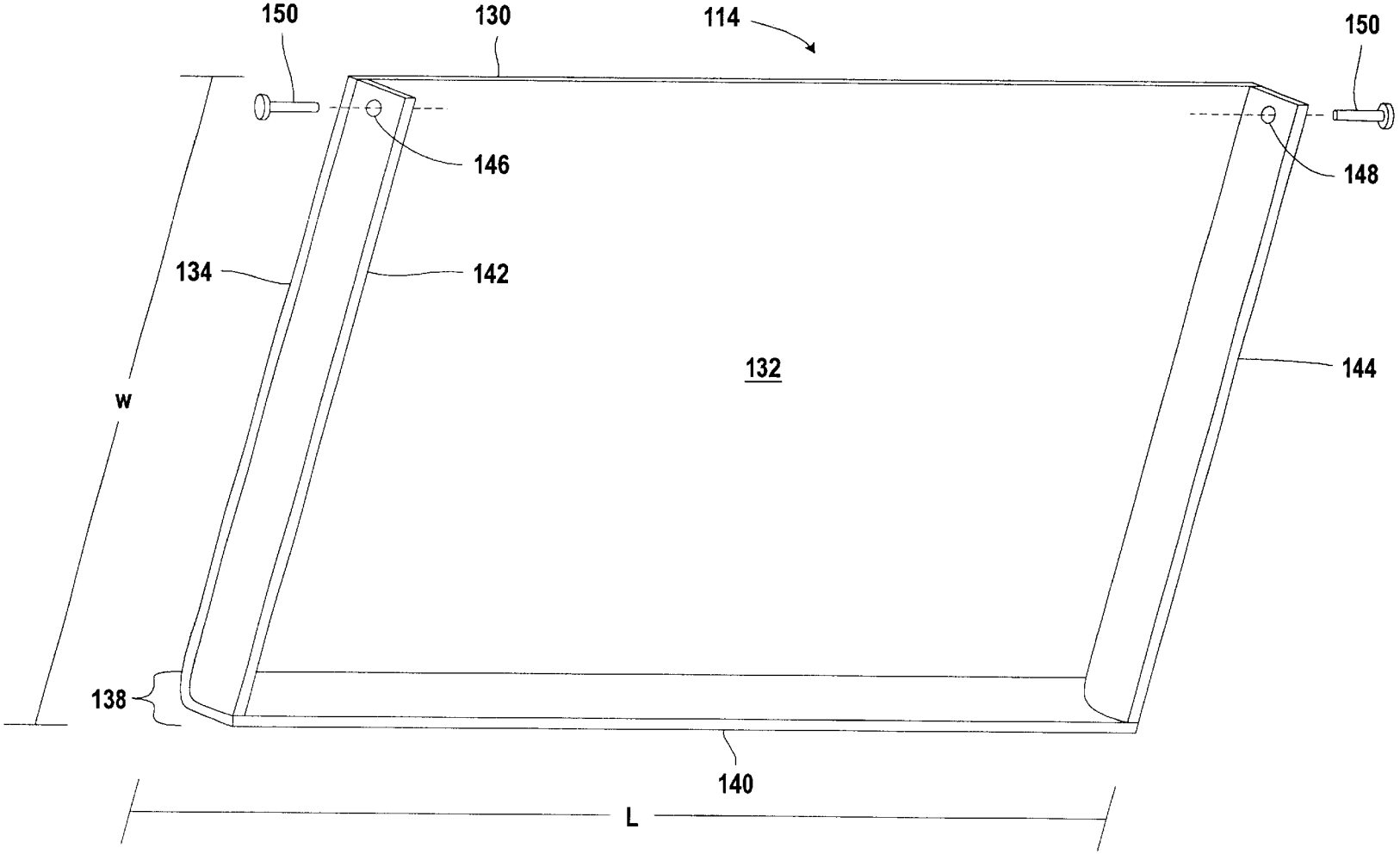
FIG. 11 is a perspective view of a support member.
Figure 12:
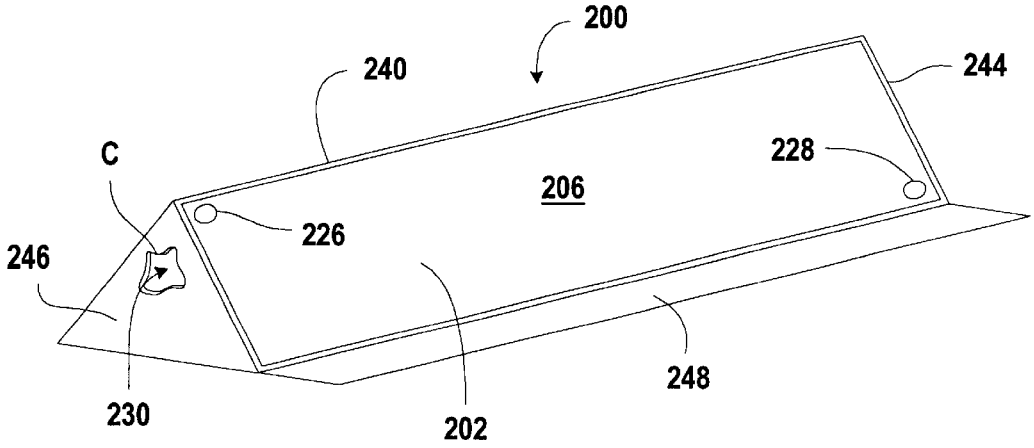
FIG. 12 is a perspective view of another embodiment of a barrier in accordance with the invention.
Figure 13:
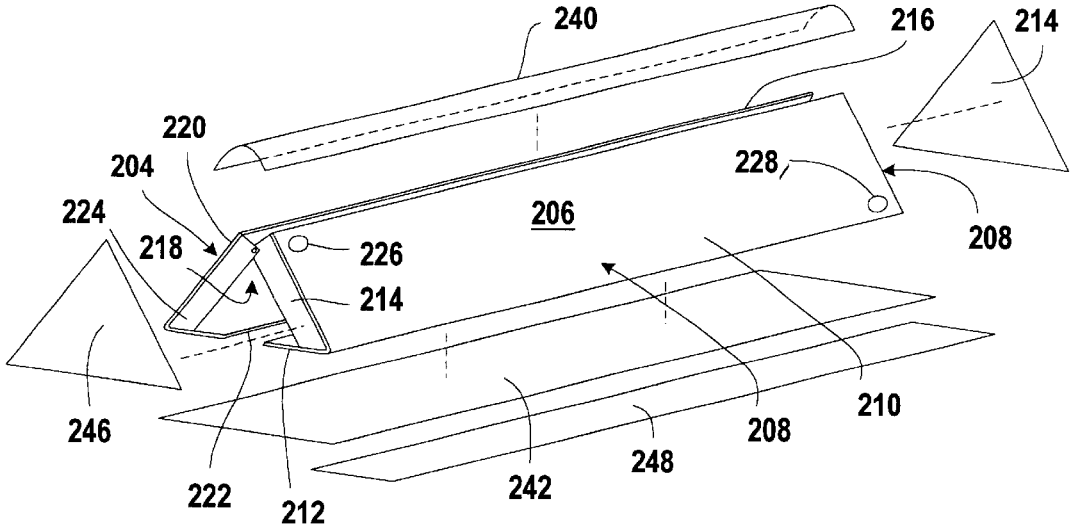
FIG. 13 is an exploded view of the barrier of FIG. 12.

With further reference now to FIGS. 9–11, each support member 114 and 118 is preferably of one-piece construction and includes a substantially flat portion 130 having an inner surface 132 opposite an outer surface 134, with the outer surface 134 being the surface that is attached to the inner surface 116 of the body portion 102. In addition to the flat portion 130, each member 114 or 118 preferably includes a lower end 138 that is curved away from the surface 132 to provide a leg portion 140 that extends along the length of the support member and in a direction substantially perpendicular to the surface 132. In addition, end portions 142 and 144 preferably extend perpendicularly away form the surface 132 adjacent the ends of the flat portion 130. Apertures 146 and 148 extend through the end portions 142 and 144, respectively, adjacent the ends thereof opposite the leg portion 140 for receiving fasteners 150 to hindgedly connect a pair of the members 114, 118 together, as best seen in FIG. 10. For example, the members 114 and 118 are placed with the inner surfaces 132 generally facing one another and the apertures 148, 146 of each aligned. The fastener 150, such as a cotter pin, is placed through each pair of aligned apertures to connect the members 114 and 118 together. The hinge action enables the barrier 100 to be folded in the manner previously described in connection with the barrier 10 of FIGS. 1–6. Likewise, a plurality of the barriers 100 may be stacked and otherwise arranged in the manner described for the barrier 10.

FIGS. 12–14*c*

With reference to FIGS, 12–14*c*, there are shown perspective views of an alternate embodiment of a barrier 200 in accordance with the invention. The barrier 200 includes a pair of substantially rigid support members 202 and 204 hingedly connected together by fasteners, such as pins 206. The barrier 200 is fillable, foldable and stackable in the manner previously described for the barrier 10.

The support members 202 and 204 are preferably identical to the support members 114 and 118 previously described in connection with FIGS. 7–11. Accordingly, the support member 202 includes a substantially flat portion 206 having an inner surface 208 and an outer surface 210, a leg portion 212 and an end portion 214 at each end thereof. Likewise, the support member 204 includes a substantially flat portion 216 having an inner surface 218 and an outer surface 220, a leg portion 222 and an end portion 224 at each end thereof. A pair of ports 226 and 228 preferably extend through the flat portion 206 for introducing and removing fluid from the barrier 200.

A substantially fluid impervious chamber 230 within the barrier 200 (shown via cutout C) is provided for receiving fluid, such as water, by surrounding the edges of the support members 204 and 206 with portions of a flexible material, such as PVC and attaching the edges of the flexible material to the support members 204 and 206. For example, the barrier 200 preferably includes portions of flexible material such as an upper portion 240, a bottom portion 242, end portions 244 and 246, and flap portion 248.

Figure 14A:
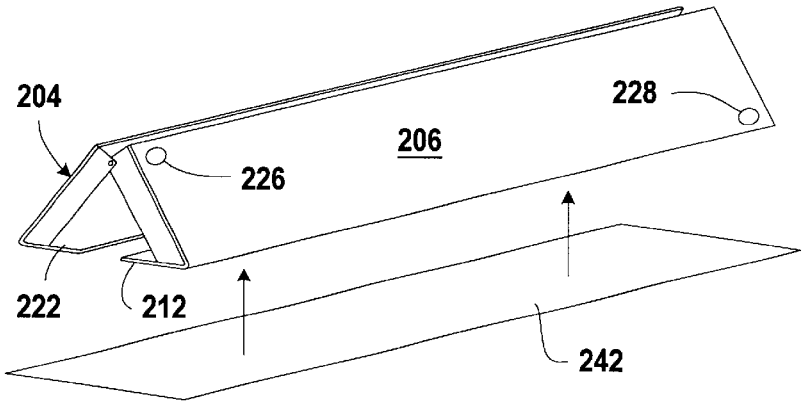
FIGS. 14*a*–14*c* shows steps in the manufacture of the barrier of FIG. 12.
Figure 14B:
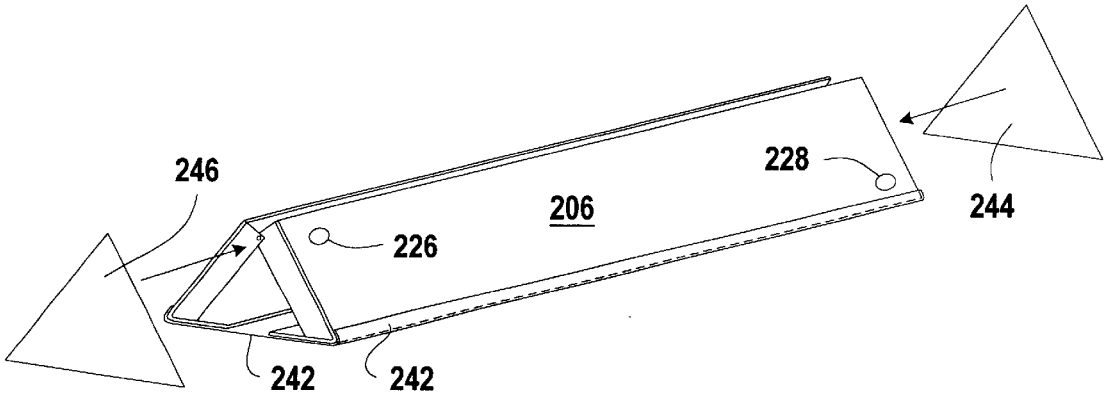
Figure 14C:
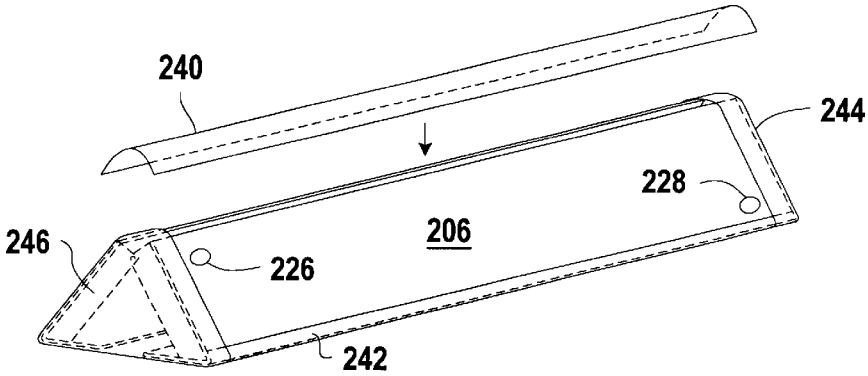

FIGS. 14*a*–14*c* show a preferred method of assembling the barrier 200. For example, as shown in FIG. 14*a*, the bottom portion 242 is first secured, by adhesive or heat sealing, to the bottoms of the leg portions 212 and 222 of the support members 204 and 206, then wrapped around the lowermost edges of the support members 204 and 206 and sealed thereto. The flap portion 248 may then be attached to the bottom portion 242. Next, in FIG. 14*b*, the end portions 244 and 246 are wrapped around the edges of the support members 204 and 206 (overlapping portions of the bottom portion 242) and sealed in place. Finally, the upper portion 240 is folded as shown and laid over the gap between the upper portion of the support members 204 and 206 and sealed in place.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. A barrier comprising a fluid-fillable body made of a non-rigid sheet material, a plurality of planar support members within the body for maintaining a desired shape of the barrier, each planar support member being hingedly connectable to another planar support member, and a port for introducing fluid into the body.

2. The barrier of claim 1, wherein the desired shape of the barrier comprises a triangular shape.

3. The barrier of claim 1, wherein the non-rigid sheet material comprises polyvinyl chloride.

4. The barrier of claim 1, wherein the fluid comprises water.

5. A flood barrier, comprising:

a body portion made of a non-rigid sheet material and having a first end, a second end in opposed relation to the first end, a first side attached to the first and second ends;

a first planar support member made of a substantially rigid sheet material and having a width substantially equal to the width of the first side, the first planar support member being attached to an interior surface of the first side for substantially maintaining the form of the first side;

a second side attached to the first and second ends and the first side;

a second planar structural support member made of a substantially rigid sheet material and having a width substantially equal to the width of the second side, the second planar support member being attached to an interior surface of the second side for maintaining the form of the second side;

a base attached to said first and second ends and said first and second sides;

the first and second ends and the first, second, and the base defining the body portion; and at least one port in fluid communication with an interior chamber of the body portion for introducing liquid into the interior chamber of the body portion.

6. The barrier of claim 5, wherein the body portion is triangular in cross-section.

7. The barrier of claim 5, wherein the first and second planar support members are hingedly connected to one another, with each planar support member having a length and a width and comprising a substantially flat portion having an inner surface opposite an outer surface, a lower end that is curved away from the inner to provide a leg portion that extends along the length of the support member and in a direction substantially perpendicular to the surface inner, a pair of end portions aligned with the width of the support member and extending perpendicularly away form the inner surface, with each end portion having an aperture extending therethrough for receiving a fastener, wherein a pair of the support members are positionable with the inner surfaces thereof generally facing one another and the apertures of the end portions aligned for receiving fasteners for hingedly connecting the support members to one another.

8. A levee system, comprising a plurality of barriers, wherein each barrier comprises:

a body portion made of a non-rigid sheet material and having a first end, a second end in opposed relation to the first end, a first side attached to the first and second ends;

a first planar support member made of a substantially rigid sheet material and having a width substantially equal to the width of the first side, the first planar support member being attached to an interior surface of the first side for substantially maintaining the form of the first side;

a second side attached to the first and second ends and the first side;

a second planar structural support member made of a substantially rigid sheet material and having a width substantially equal to the width of the second side, the second planar support member being attached to an interior surface of the second side for maintaining the form of the second side;

a base attached to said first and second ends and said first and second sides;

the first and second ends and the first, second, and the base defining the body portion; and at least one port in fluid communication with an interior chamber of the body portion for introducing liquid into the interior chamber of the body portion.

* * * * *